US008800340B2

(12) United States Patent
Lu

(10) Patent No.: US 8,800,340 B2
(45) Date of Patent: Aug. 12, 2014

(54) METHOD OF MAKING MICRO-HOLES ON METAL PLATE

(75) Inventor: Shih-Ming Lu, Tainan Hsien (TW)

(73) Assignee: CKM Building Material Corp., Tainan Hsien (TW)

( * ) Notice: Subject to any disclaimer, the term of this patent is extended or adjusted under 35 U.S.C. 154(b) by 717 days.

(21) Appl. No.: 13/120,466

(22) PCT Filed: Jul. 24, 2009

(86) PCT No.: PCT/CN2009/072901
§ 371 (c)(1),
(2), (4) Date: Mar. 23, 2011

(87) PCT Pub. No.: WO2011/009240
PCT Pub. Date: Jan. 27, 2011

(65) Prior Publication Data

US 2011/0265539 A1 Nov. 3, 2011

(51) Int. Cl.
*B21D 31/02* (2006.01)

(52) U.S. Cl.
USPC ..... 72/326; 72/325; 72/332; 72/379.2

(58) Field of Classification Search
USPC ..... 72/324, 325, 326, 332, 379.2, 380, 386
See application file for complete search history.

(56) References Cited

U.S. PATENT DOCUMENTS

| | | | | | |
|---|---|---|---|---|---|
| 2,781,097 | A * | 2/1957 | Nold | 72/326 |
| 3,580,040 | A * | 5/1971 | Lang | 72/324 |
| 3,913,420 | A * | 10/1975 | Coon | 76/13 |
| 4,055,132 | A * | 10/1977 | Stohrer et al. | 72/326 |
| 4,067,215 | A * | 1/1978 | Nakajima et al. | 72/40 |
| 4,430,784 | A * | 2/1984 | Brooks et al. | 29/890.1 |
| 7,669,329 | B2 * | 3/2010 | Ogawa et al. | 29/890.1 |
| 2004/0187544 | A1 * | 9/2004 | Van Dalen et al. | 72/326 |

* cited by examiner

*Primary Examiner* — Edward Tolan
(74) *Attorney, Agent, or Firm* — Rosenberg, Klein & Lee

(57) ABSTRACT

A method of making micro-holes on a metal plate includes: (A) feeding a metal plate on a workbench forward to extend beyond a shearing edge; (B) locating a punching head at a first position, and keeping a working space between the punching head and the workbench; (C) exerting a shearing force towards the workbench by the punching head; (D) bending the metal plate by the shearing force, and forming a plurality of spot-shaped cavities arranged in a row on a second surface; (E) bearing a shearing force on the first surface of the metal plate to form a linear groove; (F) deforming the metal plate by the shearing force to cause the spot-shaped cavities arranged in a row to communicate with the linear groove to form micro-holes; (G) the punching head returning to the first position and moving a working distance to a second position; (H) feeding the metal plate again; (I) the punching head repeating the above steps at the second position; (J) the punching head returning to the second position and then moving back to the first position to complete a processing cycle. The method can produce a maximum of micro-holes on a certain area of the metal plate, which can be used as a sound gobo with an enhanced sound-absorption rate.

17 Claims, 11 Drawing Sheets

METHOD OF MAKING MICRO-HOLES ON METAL PLATE

BACKGROUND OF THE INVENTION (a) Field of the Invention

The present invention relates to a method of making micro-holes on a metal plate, in particular to a method of making a maximum of micro-holes per unit area on a metal plate.

(b) Description of the Related Art

In the present living environment, various different noises are produced, which affect the quality of our living significantly, so that all kinds of sound absorbing or isolating devices are introduced to solve the noise problem. Among these devices, a sound gobo has an excellent sound absorbing effect, and the structure of the sound gobo is originated from the famous Chinese academician, Mr. Ta-yu Ma's "Micro perforated sound absorption panel theory" in 1970, and the theory primarily forms a plurality of micro-holes on a surface of a panel, wherein the diameter of the micro-hole is smaller than the thickness of the panel, such that after a sound enters into the micro-holes (tunnels), kinetic energy of sound wave and air molecules will pass through the center of the tunnels quickly and attach onto the walls of the tunnels. Friction produced by the molecules will attenuate the sound until the kinetic energy of the molecules is converted into heat energy, so as to achieve the sound absorption effect. The inventor of the present invention based on this theory has obtained an issued patent (Taiwan Utility Model Pat. No. M289784, entitled "Metal sound gobo" on Apr. 21, 2006, and the metal sound gobo of the patented invention comprises a plurality of triangular cones, having an elliptical micro-hole at the bottom of each triangular cone and concavely formed at the bottom of a metal plate, a slightly wave-like surface formed at the top of the metal plate, and a triangular cone concavely formed around the periphery at the top of the wave-like surface and disposed at a position corresponding to the elliptical micro-hole, such that the reflected sound waves are attenuated by their collision and interference with each other. In the meantime, even if some of the sound waves pass through the elliptical micro-holes formed at the bottom of the triangular cones, an acoustic transmission loss will occur to achieve a better sound absorption and a quicker assembling effect.

The inventor of the present invention has further filed a patent application (Taiwan Patent Application No. 200920902, entitled "Geometric micro-hole sound gobo" on May 16, 2009, and the geometric micro-hole sound gobo of the patent application comprises a metal plate installed at the bottom of a floor layer, and a micro-hole camber and a geometrical micro-hole groove concavely and respectively formed on the top and bottom of the plate and interconnected with each other, such that refractions occurred at conical surfaces of different angles promotes the interference phenomenon and depletes the kinetic energy of air molecules, and an air layer between the plate and the floor layer can increase the friction loss of the kinetic energy of the sound waves, so as to achieve a good sound absorption effect.

However, both of the aforementioned patent and patent application use the "micro-hole panel sound absorption theory" and common sound gobo available in the market also comes with the structure manufactured and produced according to this theory. Since the sound-absorption rate is related to the quantity of micro-holes per unit area of the panel (or plate), therefore a maximum of micro-holes formed on the plate not only improves the sound-absorption rate, but also saves material and manufacturing costs.

Most of conventional sound gobos adopts the manufacturing technique of using a punching machine to punch holes on a plate directly. The direct punching process can produce 40000 to 50000 micro holes per every square meter on the plate, but the minimum diameter of each micro hole can reach 0.45 mm only, and thus it is difficult to punch more holes with a smaller diameter on unit area of the sound gobo. As a result, the average noise reduction coefficient (NRC) can reach 0.15 to 0.5 (wherein, the less the numerical value of NRC, the better is the sound-absorption rate).

SUMMARY OF THE INVENTION

In view of the difficulty for conventional sound gobos to make a maximum of micro-holes per unit area of a plate and improve the sound-absorption rate effectively, it is a primary objective of the present invention to provide a method of making micro-holes on a metal plate in order to form a maximum of micro-holes on a specific unit area of the metal plate and improve the sound-absorption rate.

To overcome the aforementioned technical problem, the present invention adopts a solution as described below:

A method of making micro-holes on a metal plate primarily adopting a shearing tool to shear and manufacture a plate with appropriate hardness and ductility, and the method comprises the following steps:

(A) feeding a metal plate on a workbench forward to extend beyond a shearing edge of the workbench, such that a first surface disposed at the bottom of the metal plate is contacted with the workbench, and a part of the metal plate is protruded and extended beyond the shearing edge of the workbench;

(B) locating a punching head at a first position at the top of the shearing edge of the workbench, and maintaining a working space between the punching head and the workbench, wherein the punching head includes a plurality of unit blade portions arranged in a row parallel to the shearing edge of the workbench;

(C) applying a shearing force to the workbench by the punching head;

(D) applying a force to bend the metal plate along the direction of applying force by the punching head, and forming a plurality of spot-shaped cavities arranged in a row on a second surface of the metal plate by an action of the unit blade portions towards the punching head;

(E) bearing the shearing force on the first surface on the metal plate to form a linear groove along the shearing edge of the workbench;

(F) deforming the metal plate by the shearing force, interconnecting the spot-shaped cavities arranged in a row on the second surface with the linear groove on the first surface, and forming a plurality of micro-holes at the intersection of the interconnection;

(G) returning the punching head to the first position, and then shifting the punching head to a working distance in a direction parallel to the shearing edge to a second position;

(H) feeding the metal plate in a direction towards the shearing edge of the workbench again;

(I) repeating Steps C, D, E and F when the punching head is situated at the second position; and (J) returning the punching head to the second position, and then shifting the punching head to a working distance in a direction parallel to the shearing edge of the workbench and returning the punching head to the first position to complete a processing cycle.

The number of unit blade portions in Step B and the feed stroke of the metal plate in Step H are controlled, such that the number of the micro-holes formed on the metal plate ranges from 80000 to 450000 per square meter.

The number of unit blade portions in Step B and the feed stroke of the metal plate in Step H are controlled, such that the number of the micro-holes formed on the metal plate ranges from 250000 to 400000 per square meter.

The metal plate has a hardness HRB ranging from 8 to 40 and a ductility ranging from 4 to 30.

The unit blade portions are arranged in a sawtooth shape.

The working distance is less than a pitch between two adjacent unit blade portions.

The working distance is equal to one half of a pitch between two adjacent unit blade portions.

The step F further comprises a Step F1 to control a stroke of the punching head, such that the micro-holes formed after the spot-shaped cavities arranged in a row on the second surface of the metal plate and the linear groove on the first surface of the metal plate are interconnected have a minimum width in the vertical direction smaller than the thickness of the metal plate.

The Step F further comprises a Step F2 to control a stroke of the punching head, such that the micro-holes formed after the spot-shaped cavities arranged in a row on the second surface of the metal plate and the linear groove on the first surface of the metal plate are interconnected have a width along the linear groove greater than the width in the direction of feeding the metal plate.

The Step F further comprises a Step F3 to control a stroke of the punching head, such that the micro-holes formed after the spot-shaped cavities arranged in a row on the second surface of the metal plate and the linear groove on the first surface of the metal plate are interconnected are disposed at the top of the linear groove.

The method further comprises a leveling process for leveling the first surface and the second surface of the metal plate after the Step J takes place.

The method further comprises a coating process for coating a film on the leveled first surface and second surface of the metal plate after the leveling process of the metal plate takes place.

The unit blade portions arranged in a row as described in step B are in a sawtooth shape.

With the aforementioned technical measures, the present invention has the following advantages:

1. The present invention can make a maximum of micro-holes on a specific unit area of a metal plate, such that the material and manufacturing costs can be saved significantly.

2. The present invention can make a maximum of micro-holes on a specific unit area of a metal plate, such that the sound absorption can reduce noises effectively and achieve the best noise pollution effect.

3. The metal plate manufacturing in accordance with the method of the present invention has the light-weight, poisonless, fire resisting, salt resisting, moisture resisting, high sound-absorption rate, long life, diversified color, easy-to-cut and easy-to-install properties, and it is used expensively in a high-temperature, high-humidity, super-clean and/or high-speed airflow environment such as architecture, construction, air-conditioning, machinery, electronics, medical treatment, traffic and transportation, etc, and the plate can serve as a dustproof, fireproof, waterproof, poisonless and durable sound gobo.

DETAILED DESCRIPTION OF THE PREFERRED EMBODIMENTS

Figure 1:
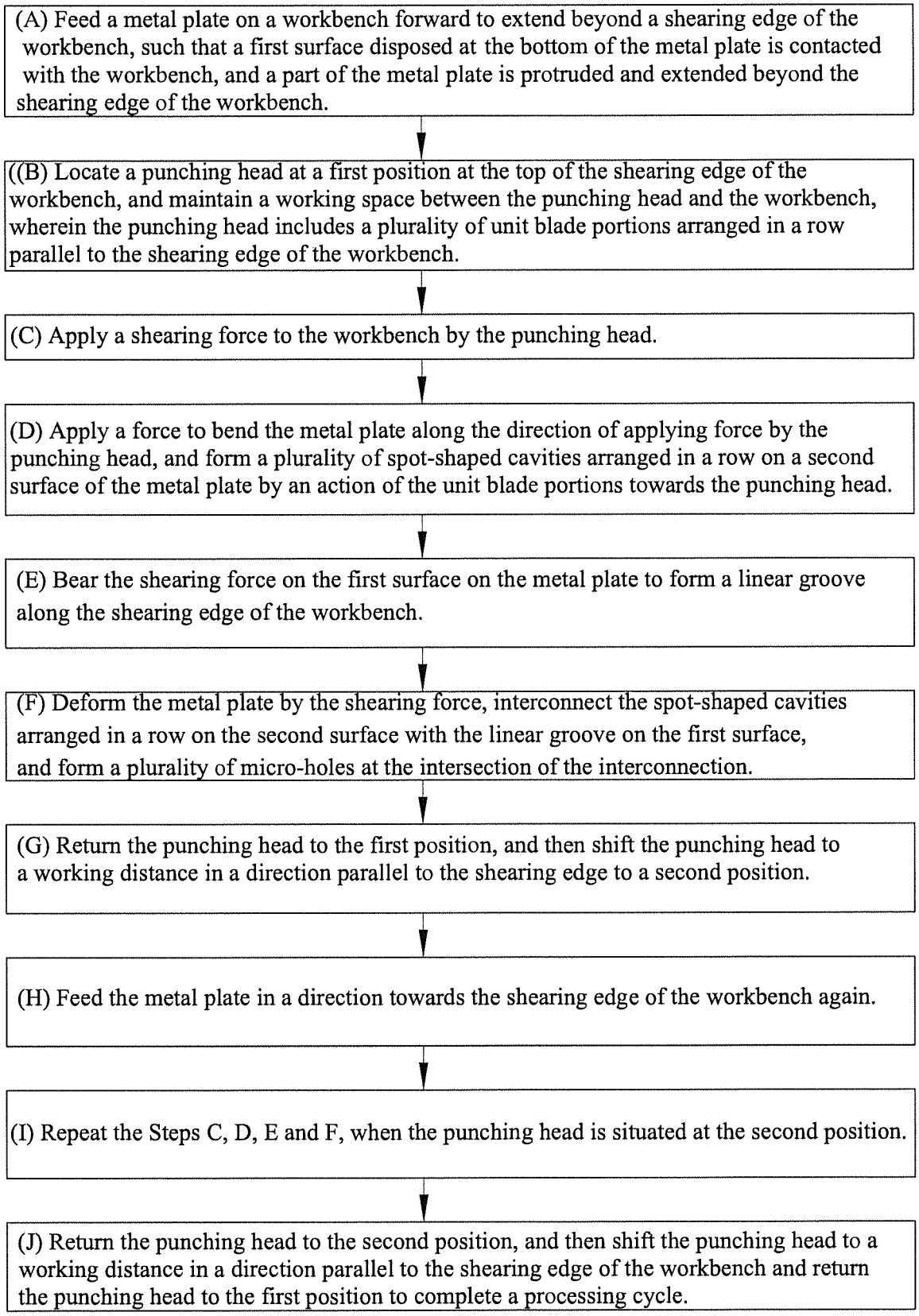
FIG. 1 is a flow chart of a method of making micro-holes on a metal plate in accordance with the present invention.
Figure 2:
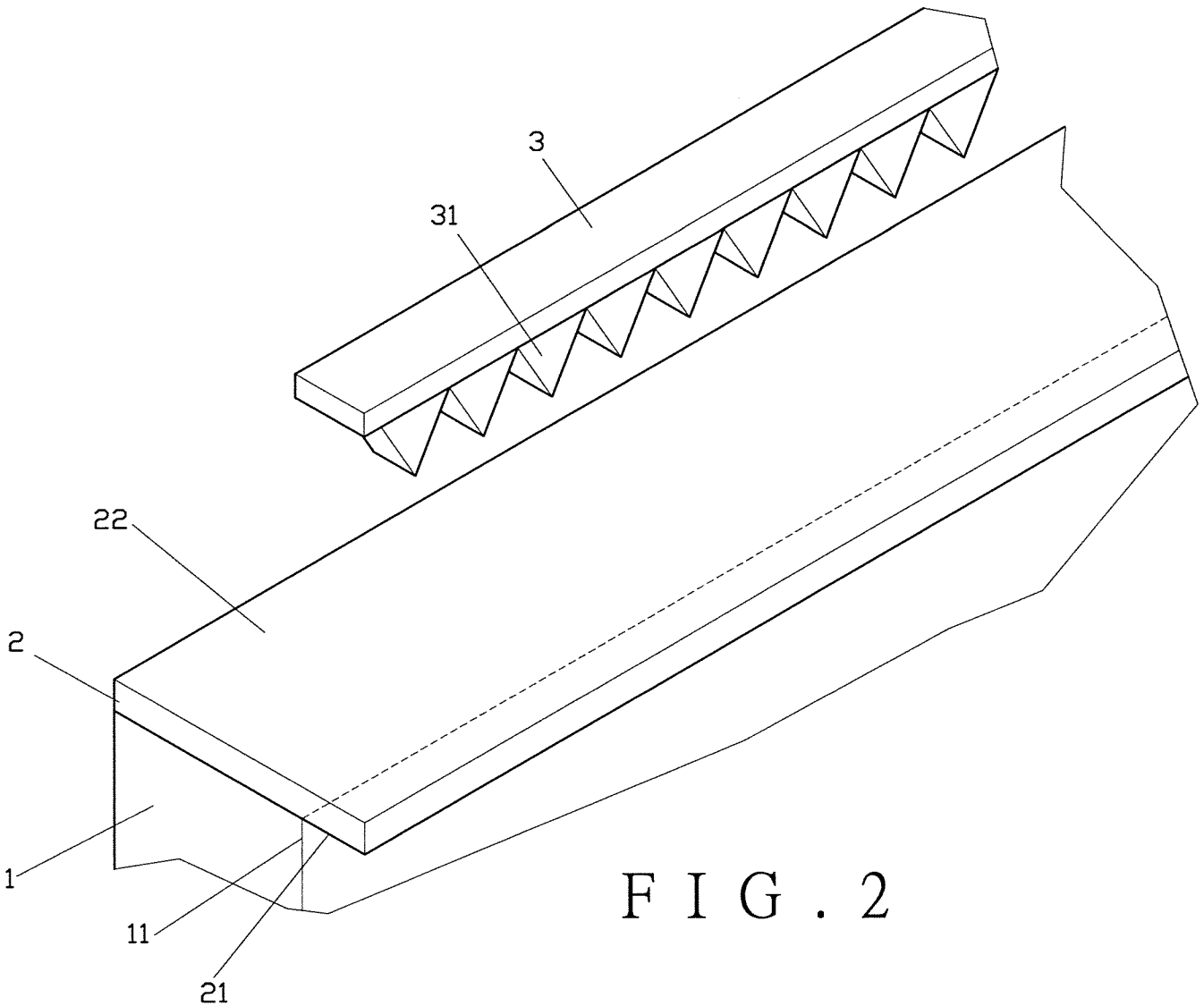
FIG. 2 is a schematic view of feeding the metal plate on the workbench while the punch head is situated at the first position in accordance with the present invention.

With reference to FIG. 1 for a method of making micro-holes on a metal plate in accordance with a preferred embodiment of the present invention, the method comprises the following steps:

A. Feed a metal plate 2 on a workbench 1 forward to extend beyond a shearing edge 11 of a workbench 1 (as shown in FIG. 2), and convey the metal plate 2 to be punched on the workbench 1, such that the metal plate 2 moves towards the shearing edge 11 of the workbench 1, and a part of the metal plate 2 to be punched is protruded and extended beyond the shearing edge 11 of the workbench 1 and situated at a suspending form, and the metal plate 2 includes a first surface 21 at the bottom and a second surface 22 at the top, and the metal plate 2 has a hardness HRB from 8 to 40 and a ductility from 4 to 30.

Figure 3:
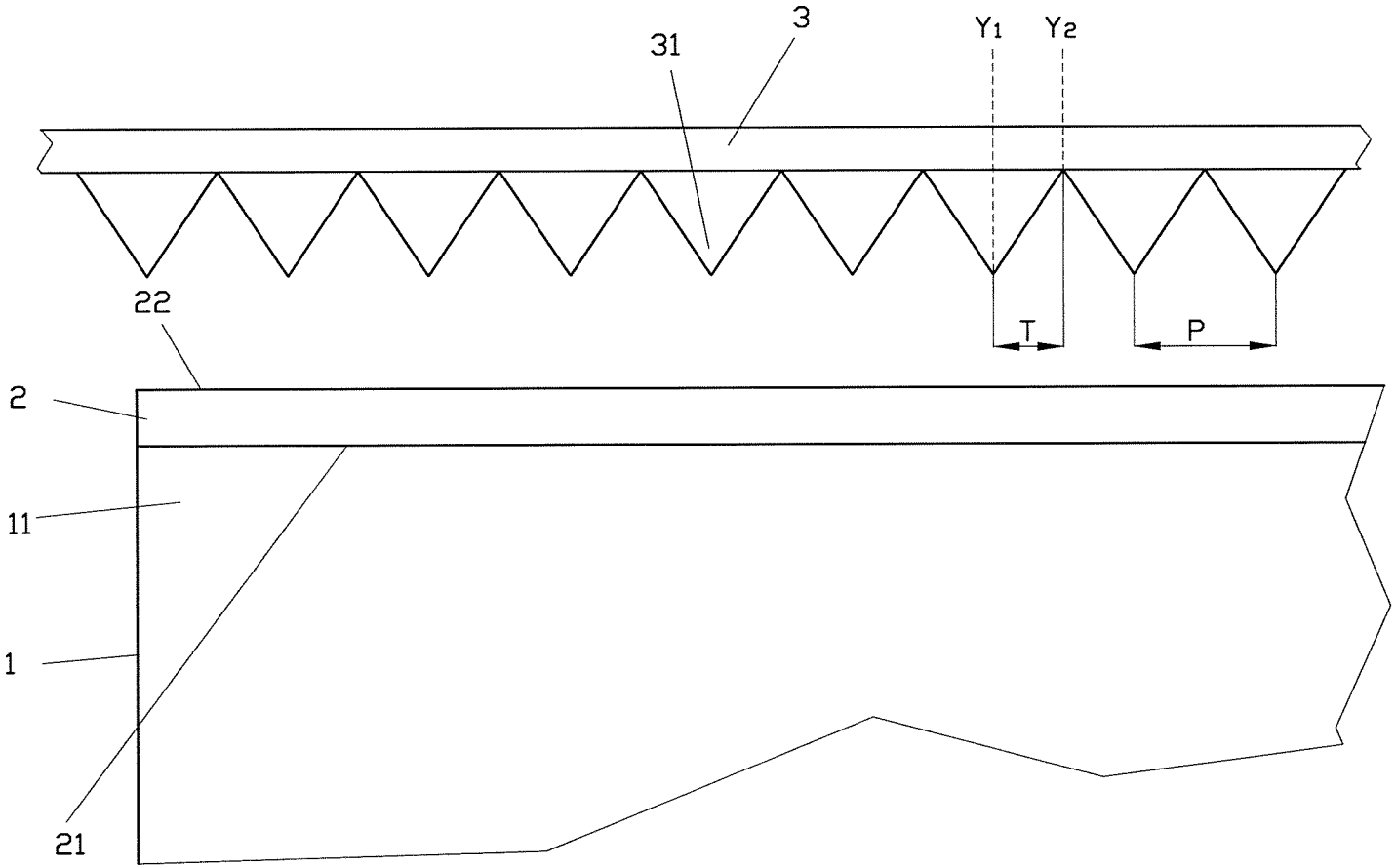
FIG. 3 is a schematic view, showing the distance of moving the punching head from the first position to the second position in accordance with the present invention.
Figure 4:
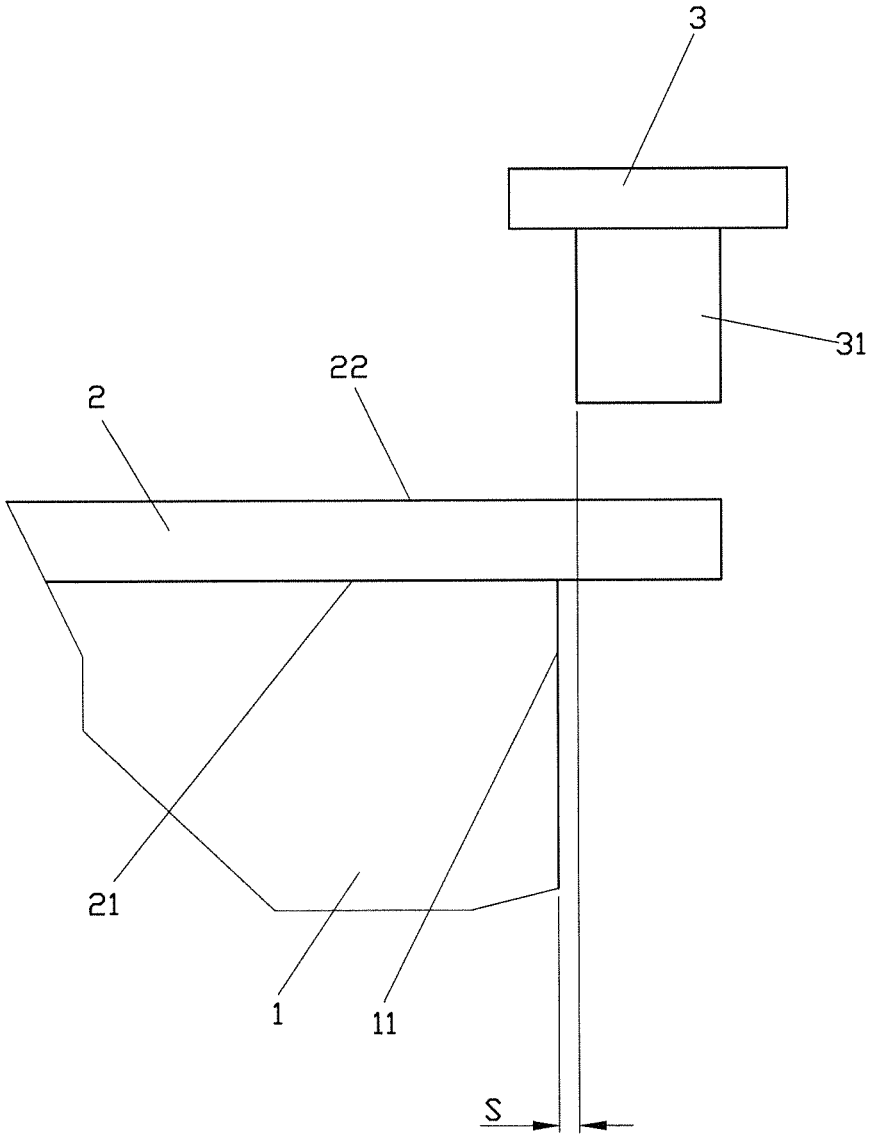
FIG. 4 is a schematic view of the punching head ready for exerting a shearing force to the metal plate in accordance with the present invention.

B. Locate a punching head 3 at a first position Y1 above the shearing edge 11 of the workbench 1, and maintain a working space S between the punching head 3 and the workbench 1, and the punching head 3 includes a plurality of unit blade portions 31 arranged in a row parallel to the shearing edge 11 of the workbench 1; and install the punching head 3 at a first position Y1 above the shearing edge 11 of the workbench 1 (as shown in FIG. 3), and the first position Y1 and the shearing edge 11 are perpendicular, and the working space S is maintained between the vertical direction of the punching head 3 and the shearing edge 11 of the workbench 1 (as shown in FIG. 4), and the punching head 3 includes at least one unit blade portion 31 arranged in a row, and the unit blade portions 31 are arranged into a sawtooth shape.

Figure 5:
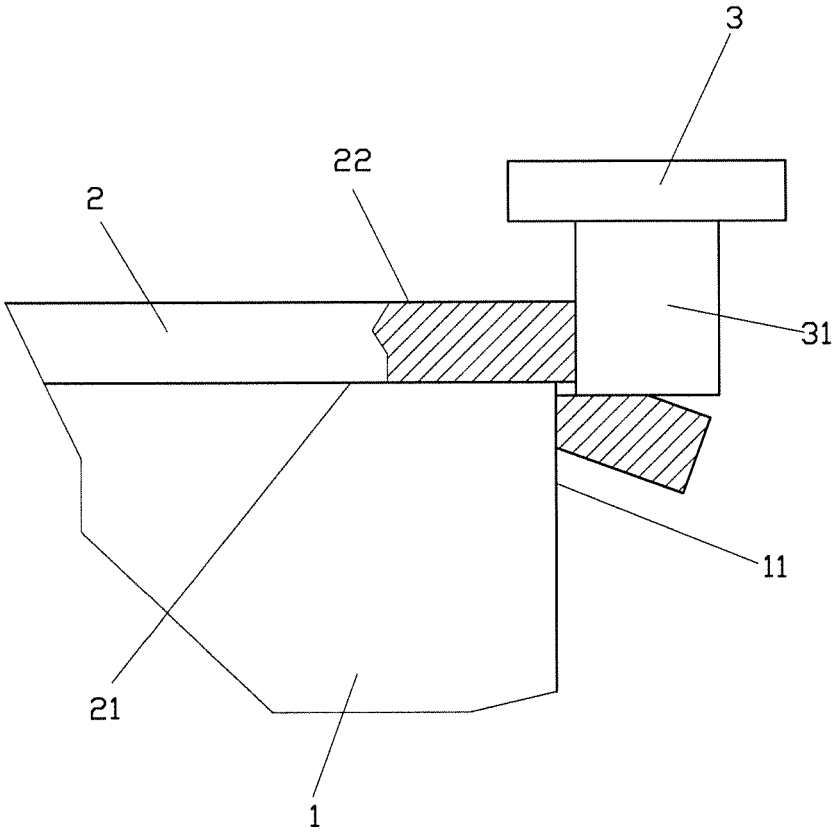
FIG. 5 is a schematic view of the punching head exerting a shearing force to the metal plate in accordance with the present invention.

C. The punching head 3 applies a shearing force towards the workbench 1, such that when the punching head 3 applies a force vertically downward at the first position Y1, a shearing force is produced due to the working space S formed between the vertical direction of the punching head 3 and the shearing edge 11, and the unit blade portion 31 of the punching head 3 and the shearing edge 11 of the workbench 1 are contacted (as shown in FIG. 5).

Figure 6:
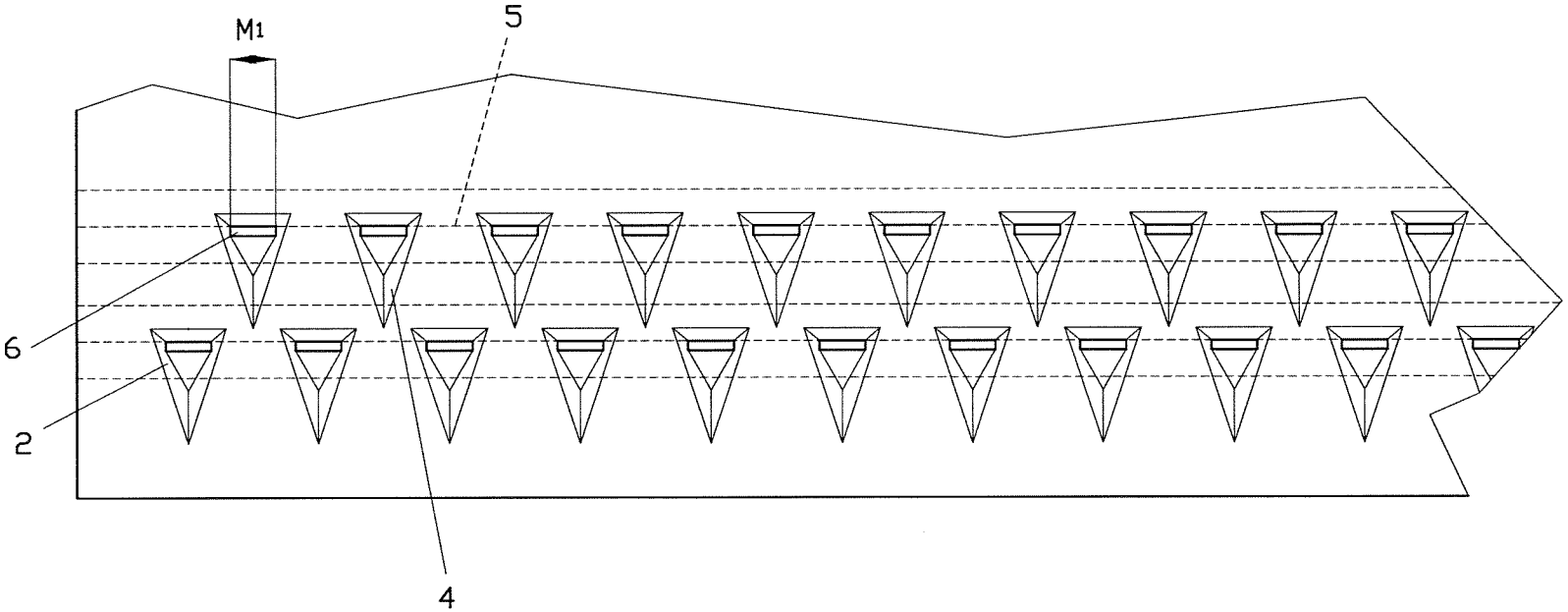
FIG. 6 is a schematic view of forming micro-holes on the metal plate by the linear groove containing spot-shaped cavities arranged in a row in accordance with the present invention.

D. Apply a force to bend the metal plate 2 in a direction of applying the force by the punching head 3, and the metal plate 2 is acted by the unit blade portion 31 towards the second surface 21 of the metal plate 2 to form a plurality of spot-shaped cavities 4 arranged in a row; after the punching head 3 applies a force downwardly at the metal plate 2, a part of the metal plate 2 extended beyond the shearing edge 11 and suspended in the air will be bent along the force applying direction, and the unit blade portion 31 of the punching head 3 will punch a plurality of spot-shaped cavities 4 arranged in a row on the second surface 22 of the metal plate 2 and proximate to the shearing edge 11 (as shown in FIG. 6).

E. Bear a shearing force on the first surface of the metal plate to form a linear groove along the shearing edge of the workbench; and since the metal plate 2 is bent by the shearing force, and an upward abutting force from the shearing edge 11 will be exerted onto the metal plate 2, therefore a linear groove 5 will be formed on the first surface 21 correspondingly.

Figure 7:
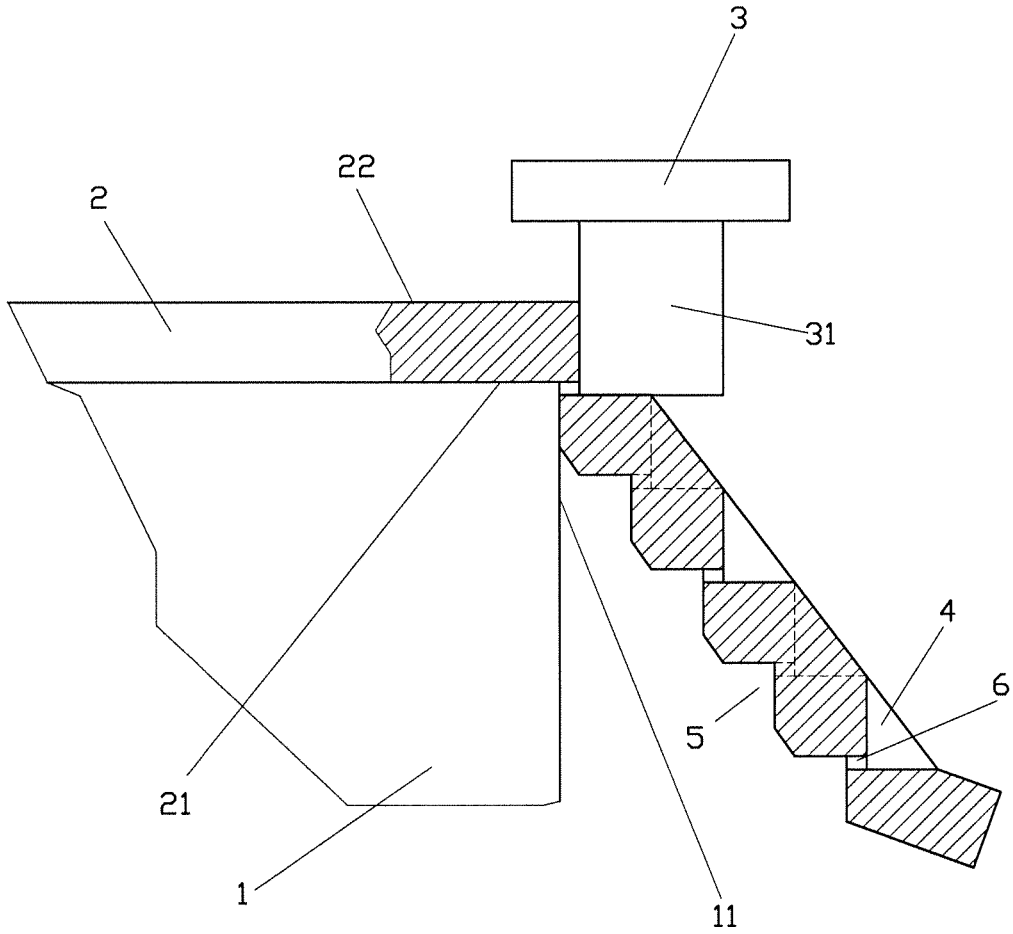
FIG. 7 is a cross-sectional view of forming micro-holes on the metal plate by repeating a punching process for several times in accordance with the present invention.

F. Deform the metal plate 2 by the shearing force, interconnect the spot-shaped cavities arranged in a row on the second surface and the linear groove on the first surface, and form a plurality of micro-holes at the intersection of the interconnection; wherein after the metal plate 2 is deformed by the shearing force, the spot-shaped cavities 4 arranged in a row on the second surface 22 and the linear groove 5 on the first surface 21 are intersected and interconnected to form micro-holes 6 (as shown in FIG. 7).

F1. The stroke of the punching head 3 is controlled, such that after the spot-shaped cavities 4 arranged in a row on the second surface 22 and the linear groove 5 on the first surface 21 are interconnected, the minimum width M1 of the micro-holes 6 is smaller than the thickness N of the metal plate 2.

F2. The stroke of the punching head 3 is controlled, such that after the spot-shaped cavities 4 arranged in a row on the second surface 22 and the linear groove 5 on the first surface 21 are interconnected, the width of the micro-holes 6 along the direction of the linear groove is greater than the width of the hole in the direction of feeding the metal plate.

F3. The stroke of the punching head 3 is controlled, such that after the spot-shaped cavities 4 arranged in a row on the second surface 22 and the linear groove 5 on the first surface 21 are interconnected, the micro-holes 6 are formed at the top of the linear groove 5.

G. Return the punching head to the first position, and then shift the punching head to a working distance in a direction parallel to the shearing edge to a second position; and then the punching head 3 ascends back to the first position Y1, and the punching head 3 shifts to a working distance T along the shearing edge 11 of the workbench 1 and then to a second position Y2 (as shown in FIG. 3), and the working distance T is smaller than a pitch P between two adjacent unit blade portions 31, and the working distance T is equal to one half of the pitch P between two adjacent unit blade portions 31.

H. Feed the metal plate in a direction towards the shearing edge of the workbench again; wherein the metal plate 2 is fed to an appropriate distance towards the shearing edge 11 of the workbench 1.

Figure 8:
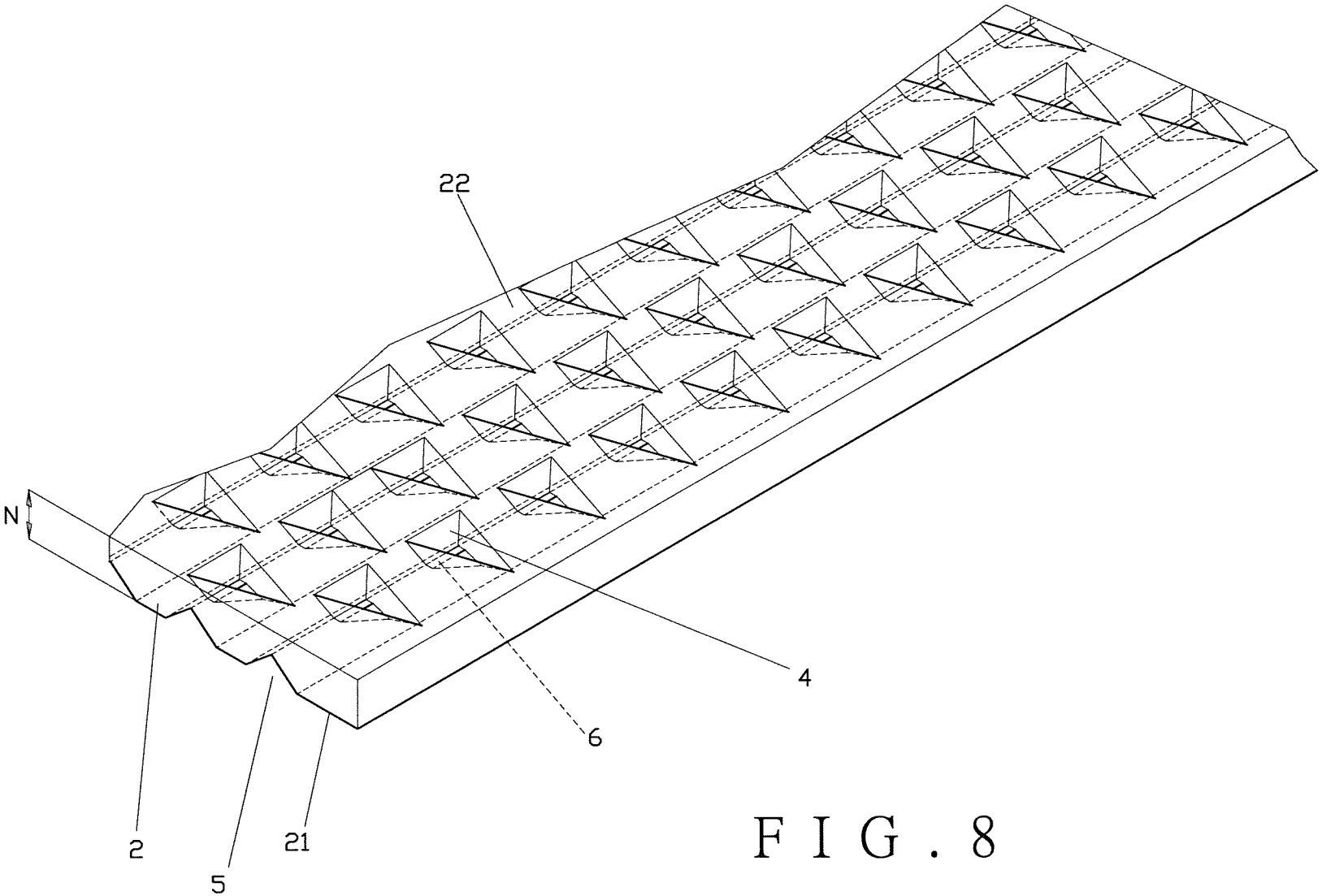
FIG. 8 is a schematic view of forming a plurality of spot-shaped cavities arranged in a row on the second surface of the metal plate and the linear groove on the first surface of the metal plate in accordance with the present invention.

I. Repeat Steps C, D, E and F when the punching head is situated at the second position; wherein after the punching head 3 feeds the metal plate 2 to an appropriate distance, the steps C, D, E and F are repeated, and a plurality of spot-shaped cavities 4 arranged in a row and a linear groove 5 are formed on the second surface 22 and the first surface 21 of the metal plate 2 respectively, and a plurality of micro-holes 6 is formed between the spot-shaped cavities 4 arranged in a row and the linear groove 5 (as shown in FIG. 8).

J. Return the punching head to the second position, and then shift the punching head to a working distance in a direction parallel to the shearing edge of the workbench and return the punching head to the first position to complete a processing cycle; wherein the punching head 3 ascends back to the second position Y2 again, and then moves in a working distance T along the shearing edge 11 of the workbench 1 and back to the first position to complete a processing cycle of the punching process.

After each step for completing the punching process of the whole metal plate 2 for several times, the method further comprises a leveling process to grind or polish the first surface 21 and the second surface 22 of the metal plate 2 to facilitate a coating process at a later stage.

After the leveling process of the metal plate 2 takes place, the method further comprises a coating process to level the metal plate 2, and a film is coated on the first surface 21 and the second surface 22, wherein the film is coated by static charges, and the thickness of the film is about 20 mic, and the micro-holes 6 are not blocked, so as to achieve the effects of preventing scratches, damages and rusts, improving the aesthetic appearance, and extending the using life.

Figure 9:
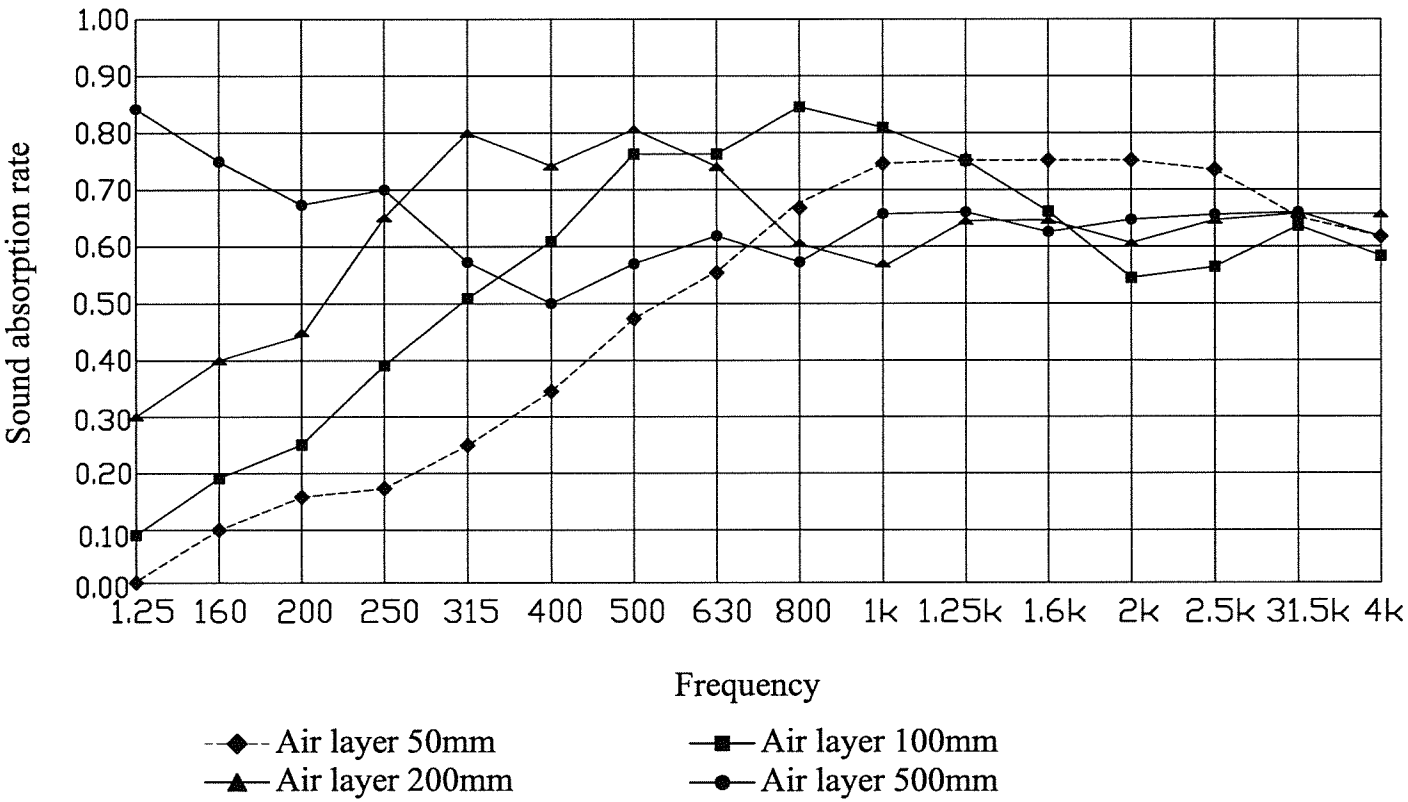
FIG. 9 is a line graph of the results of the sound-absorption test of a single-layer micro-hole sound-absorbing metal plate manufactured in accordance with the present invention.

Therefore, the present invention controls the number of unit blade portions 31 in Step B and the feed stroke of the metal plate 2 in Step H, and selects the metal plate with a hardness HRB from 8 to 40 and a ductility from 4 to 30 to manufacture the metal plate 2, and the number of the micro-holes 6 ranges from 80000 to 450000 per square meter, or the number of micro-holes 6 on the metal plate 2 ranges from 250000 to 400000 per square meter. The foregoing steps are taken to manufacture the metal plate 2 with 400000 micro-holes per square meter on the metal plate 2. In a sound absorption test, test samples including a single-layer micro-hole sound-absorbing metal plate and a double-layer micro-hole sound-absorbing metal plate are adopted, wherein the single-layer micro-hole sound-absorbing metal plate has a thickness of 1.0 mm, and a diameter of geometric hole equal to 0.08 mm, and the tests are taken at a temperature of 25□, a humidity of 60%, a sound-absorption rate of an interval in compliance with the CNS 9056 specification. The test data of the single-layer micro-hole sound-absorbing metal plate are listed in Table 1, and the line graph of the sound absorption test is shown in FIG. 9.

TABLE 1

| Air Layer Center Frequency (Hz) | 50 mm Sound-Absorbing Rate (⅓)Octave | 100 mm Sound-Absorbing Rate (⅓)Octave | 200 mm Sound-Absorbing Rate (⅓)Octave | 500 mm Sound-Absorbing Rate (⅓)Octave |
|---|---|---|---|---|
| 125 | 0.01 | 0.09 | 0.30 | 0.85 |
| 160 | 0.09 | 0.19 | 0.40 | 0.76 |
| 200 | 0.15 | 0.25 | 0.45 | 0.68 |
| 250 | 0.17 | 0.39 | 0.66 | 0.70 |
| 315 | 0.25 | 0.51 | 0.80 | 0.57 |
| 400 | 0.34 | 0.61 | 0.75 | 0.50 |
| 500 | 0.48 | 0.75 | 0.81 | 0.58 |
| 630 | 0.56 | 0.78 | 0.74 | 0.61 |
| 800 | 0.68 | 0.85 | 0.61 | 0.58 |
| 1k | 0.75 | 0.81 | 0.58 | 0.67 |
| 1.25k | 0.75 | 0.75 | 0.64 | 0.67 |

TABLE 1-continued

| Air Layer Center Frequency (Hz) | 50 mm Sound-Absorbing Rate (⅓)Octave | 100 mm Sound-Absorbing Rate (⅓)Octave | 200 mm Sound-Absorbing Rate (⅓)Octave | 500 mm Sound-Absorbing Rate (⅓)Octave |
|---|---|---|---|---|
| 1.6k | 0.76 | 0.68 | 0.66 | 0.63 |
| 2k | 0.76 | 0.55 | 0.61 | 0.65 |
| 2.5k | 0.74 | 0.57 | 0.65 | 0.66 |
| 3.15k | 0.66 | 0.63 | 0.66 | 0.67 |
| 4k | 0.61 | 0.59 | 0.67 | 0.61 |
| NRC | 0.55 | 0.65 | 0.65 | 0.65 |

If the single-layer metal plate is tested at the conditions of an air layer equal to 50 mm and a center frequency equal to 2 kHz, the sound-absorption rate will reach 0.76. If the air layer is equal to 100 mm and the center frequency is equal to 800 Hz, the sound-absorption rate will reach 0.85. If the air layer is equal to 200 mm and the center frequency is equal to 500 Hz, the sound-absorption rate will reach 0.81. If the air layer is equal to 500 mm and the center frequency is equal to 125 Hz, the sound-absorption rate will reach 0.85.

Figure 10:
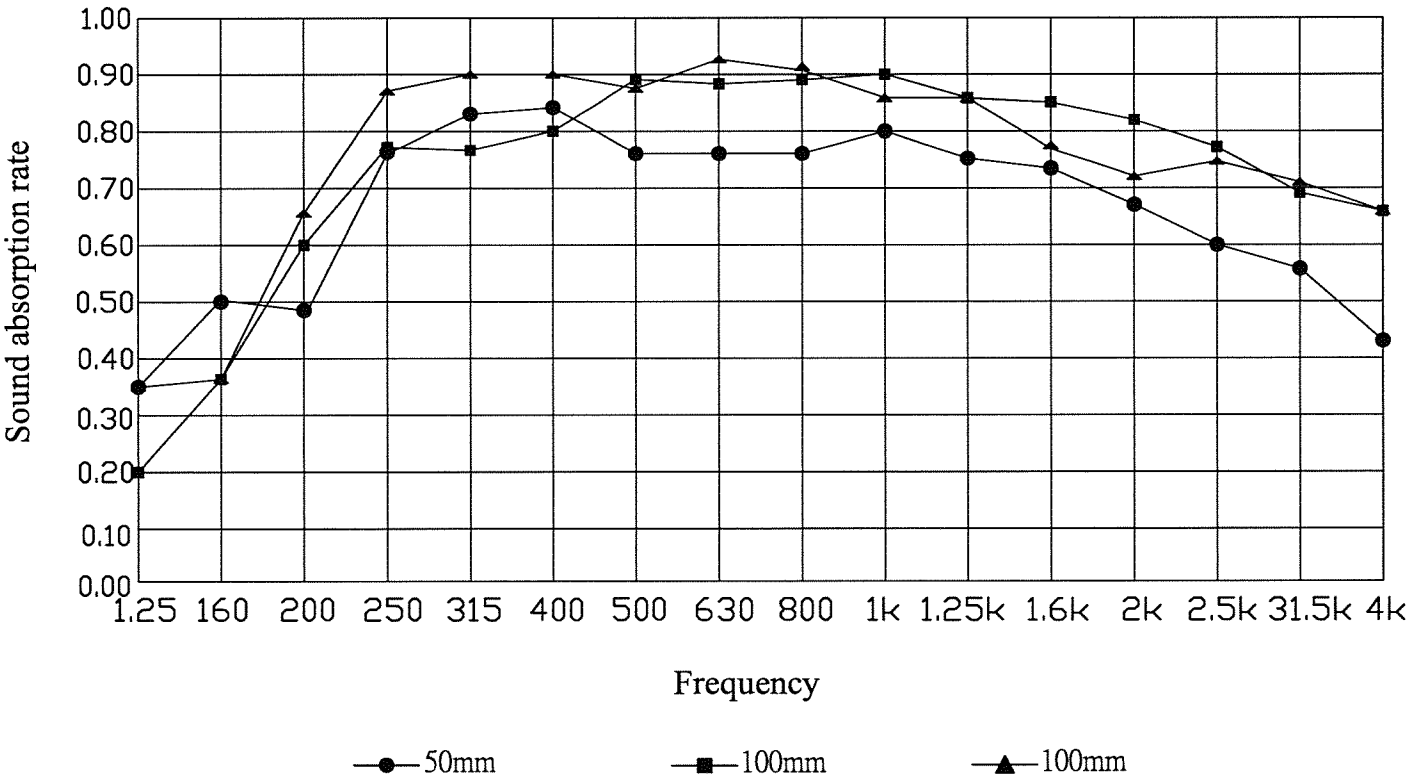
FIG. 10 is a line graph of the results of the sound-absorption test of a double-layer micro-hole sound-absorbing metal plate manufactured in accordance with the present invention.

The test data of the double-layer micro-hole sound-absorbing metal plate are listed in Table 2, and the line graph of the sound absorption test is shown in FIG. 10.

TABLE 2

| | Distance Between Two Layers | | |
|---|---|---|---|
| | 50 mm | 50 mm Air Layer | 100 mm |
| Center Frequency (Hz) | 50 mm Sound-Absorbing Rate (⅓)Octave | 50 mm Sound-Absorbing Rate (⅓)Octave | 100 mm Sound-Absorbing Rate (⅓)Octave |
| 125 | 0.33 | 0.21 | 0.35 |
| 160 | 0.49 | 0.37 | 0.36 |
| 200 | 0.48 | 0.59 | 0.65 |
| 250 | 0.75 | 0.76 | 0.88 |
| 315 | 0.82 | 0.76 | 0.91 |

TABLE 2-continued

| | Distance Between Two Layers | | |
|---|---|---|---|
| | 50 mm | 50 mm Air Layer | 100 mm |
| Center Frequency (Hz) | 50 mm Sound-Absorbing Rate (⅓)Octave | 50 mm Sound-Absorbing Rate (⅓)Octave | 100 mm Sound-Absorbing Rate (⅓)Octave |
| 400 | 0.83 | 0.79 | 0.90 |
| 500 | 0.77 | 0.89 | 0.88 |
| 630 | 0.77 | 0.88 | 0.92 |
| 800 | 0.77 | 0.88 | 0.90 |
| 1k | 0.80 | 0.89 | 0.87 |
| 1.25k | 0.74 | 0.86 | 0.86 |
| 1.6k | 0.72 | 0.85 | 0.78 |
| 2k | 0.68 | 0.80 | 0.72 |
| 2.5k | 0.59 | 0.77 | 0.75 |
| 3.15k | 0.56 | 0.69 | 0.71 |
| 4k | 0.41 | 0.66 | 0.67 |
| NRC | 0.75 | 0.85 | 0.85 |

The test sample of the double-layer micro-hole sound-absorbing metal plate comes with a thickness of 1.0 mm, the diameter of geometric holes equal to 0.08 mm, and if the test is conducted at the following conditions: a temperature of 25□, a humidity of 60%, and a sound-absorption rate for each interval in compliance with the CNS 9056 specification, and an internal between the two layers equal to 50 mm, an air layer of 50 mm, and a center frequency of 400 Hz, then the sound-absorption rate will be equal to 0.83. If the interval between the two layers is equal to 50 mm, the air layer is equal to 100 mm, and the center frequency is equal to 1 kHz, then the sound-absorption rate will be equal to 0.89. If the interval between the two layers is equal to 100 mm, the air layer is equal to 100 mm, and the center frequency is equal to 630 Hz, then the sound-absorption rate will be equal to 0.92.

Figure 11:
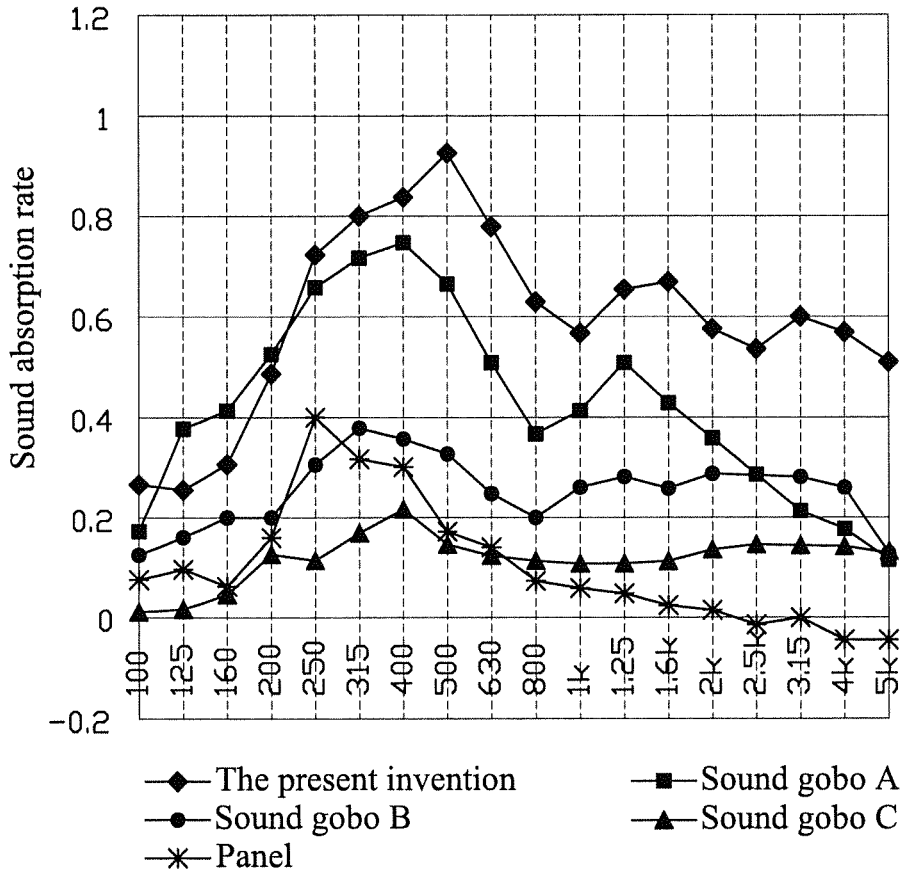
FIG. 11 is a line graph of the results of the sound-absorption test of a sound-absorbing metal plate manufactured in accordance with the present invention, various different other micro-hole sound gobos and a general panel used as a sound-absorption rate.

Further, the metal plate of the present invention is tested and compared with other porous sound gobo and a general panel, and the test data are listed in Table 3, and the line graph of the sound absorption test is shown in FIG. 11.

TABLE 3

| Product<br>Number of holes<br>Thickness (mm)<br>Hole Diameter (mm)<br>Center Frequency (Hz) | Present Invention<br>400,000 holes/$M^2$<br>Thickness 1.0<br>Height of Hole below 0.1<br>Sound-Absorbing Rate (⅓)Octave | Sound Gobo A<br>40,000 holes/$M^2$<br>Thickness 0.5<br>Hole Diameter 0.45<br>Sound-Absorbing Rate (⅓)Octave | Sound Gobo B<br>40,000 holes/$M^2$<br>Thickness 0.5~0.6<br>Height of Hole 0.5~0.6<br>Sound-Absorbing Rate (⅓)Octave | Sound Gobo C<br>55,555 holes/$M^2$<br>Thickness 0.5~0.2<br>Height of Hole 2.0~3.5<br>Sound-Absorbing Rate (⅓)Octave | Panel<br>No micro-holes<br>Thickness below 1.0<br>Sound-Absorbing Rate (⅓)Octave |
|---|---|---|---|---|---|
| 100 | 0.26 | 0.16 | 0.12 | 0.01 | 0.07 |
| 125 | 0.25 | 0.37 | 0.15 | 0.02 | 0.09 |
| 160 | 0.30 | 0.41 | 0.20 | 0.04 | 0.06 |
| 200 | 0.48 | 0.52 | 0.20 | 0.12 | 0.15 |
| 250 | 0.71 | 0.65 | 0.30 | 0.11 | 0.41 |
| 315 | 0.80 | 0.71 | 0.37 | 0.16 | 0.31 |
| 400 | 0.83 | 0.74 | 0.35 | 0.21 | 0.30 |
| 500 | 0.92 | 0.66 | 0.32 | 0.14 | 0.16 |
| 630 | 0.78 | 0.50 | 0.24 | 0.12 | 0.13 |
| 800 | 0.62 | 0.36 | 0.19 | 0.11 | 0.07 |
| 1k | 0.56 | 0.41 | 0.25 | 0.10 | 0.05 |
| 1.25k | 0.65 | 0.50 | 0.27 | 0.10 | 0.04 |
| 1.6k | 0.66 | 0.42 | 0.25 | 0.11 | 0.02 |
| 2k | 0.58 | 0.35 | 0.28 | 0.13 | 0.01 |
| 2.5k | 0.53 | 0.27 | 0.28 | 0.14 | −0.02 |
| 3.15k | 0.59 | 0.20 | 0.27 | 0.14 | −0.01 |
| 4k | 0.56 | 0.17 | 0.25 | 0.14 | −0.05 |
| 5k | 0.50 | 0.10 | 0.12 | 0.13 | −0.05 |
| NRC | 0.70 | 0.50 | 0.30 | 0.15 | 0.15 |

The sound gobo A includes 40000 micro-holes per square meter and comes with a thickness equal to 0.5 mm, and a minimum diameter of the micro-holes equal to 0.45 mm. The sound gobo B includes 40000 micro-holes per square meter and comes with a thickness from 0.5 mm to 0.6 mm, and a minimum diameter of the micro-holes from 0.5 mm to 0.6 mm. The sound gobo C includes 55555 micro-holes per square meter and has a thickness from 0.5 mm to 2 mm, and a minimum diameter of the micro-holes from 2.0 mm to 3.5 mm. The panel has no micro-holes and comes with a thickness from 0.5 mm to 1.0 mm. The number of holes of the metal plate in accordance with the present invention includes more than 400000 holes per square meter and comes with a thickness of 1.0 mm and a height of the hole less than 0.1 mm, such that the sound-absorption rate at the center frequency 500 Hz can reach up to 0.92. Among these sound gobos, the invention achieves the best sound-absorption rate, and the average of the noise reduction coefficient of the invention is equal to 0.7, but other sound gobo (without sound-absorbing backing material) has an average sound-absorption rate of 0.5 only. In conclusion, the sound absorption effect of the present invention is much better than the conventional porous sound gobo and a general panel.

What is claimed is:

1. A method of making sound attenuating micro funnels through a metal plate, comprising the steps of:

(A). feeding a metal plate on a workbench forward to extend beyond a shearing edge of the workbench, such that a first surface disposed at a bottom of the metal plate is contacted with the workbench, and a part of the metal plate is protruded and extended beyond the shearing edge of the workbench;

(B). locating a punching head at a first lateral position above the part of the metal plate protruded and extended beyond the shearing edge of the workbench defining a working space of sufficient distance between the punching head and the workbench in the feeding direction of the metal plate to permit a shearing force applied to said metal plate, wherein the punching head includes a plurality of unit blade portions arranged in a row parallel to the shearing edge of the workbench;

(C). applying the shearing force to the metal plate by the punching head external to the working space to provide said shearing force to said metal plate;

(D). bending the part of the metal plate extending beyond the shearing edge of the workbench along the direction of applying the shearing force by the punching head, and forming a plurality of spot-shaped cavities arranged in a row on a second surface of the metal plate facing the punching head, the plurality of spot-shaped cavities formed by an action of the unit blade portions disposed in the punching head;

(E). bearing the shearing force on the first surface of the metal plate to form a linear groove along the shearing edge of the workbench, the groove extending in a lateral direction transverse to the feeding direction;

(F). selectively engaging the punching head a predetermined stroke distance to deform the metal plate by the shearing force, thereby interconnecting the spot-shaped cavities arranged in a row on the second surface with the linear groove on the first surface to form a plurality of micro-holes at the intersection of the linear groove and the spot-shaped cavities;

(G). disengaging, by the predetermined stroke distance, the punching head from the metal sheet, and then shifting the punching head a predetermined lateral distance in a direction parallel to the shearing edge to a second lateral position while maintaining the working distance between the shearing edge and the punching head;

(H). feeding the metal plate in a direction towards the shearing edge of the workbench again;

(I). repeating Steps C, D, E and F when the punching head is situated at the second lateral position; and (J). disengaging, by the predetermined stroke distance, the punching head from the metal sheet, and then laterally shifting the punching head in a direction parallel to the shearing edge of the workbench to return the punching head to the first lateral position to complete a processing cycle.

2. The method as recited in claim 1, wherein the number of unit blade portions in Step B and a feed stroke of the metal plate in Step H are controlled, such that the number of the micro-holes formed on the metal plate ranges from 80000 to 450000 per square meter.

3. The method as recited in claim 1, wherein the number of unit blade portions in Step B and a feed stroke of the metal plate in Step H are controlled, such that the number of the micro-holes formed on the metal plate ranges from 250000 to 400000 per square meter.

4. The method as recited in claim 1, wherein the metal plate has a hardness HRB ranging from 8 to 40 and a ductility ranging from 4 to 30.

5. The method as recited in claim 1, wherein the unit blade portions are arranged in a sawtooth shape.

6. The method as recited in claim 1, wherein the predetermined lateral distance is smaller than a pitch between two adjacent unit blade portions.

7. The method as recited in claim 6, wherein the predetermined lateral distance is one half of a pitch between two adjacent unit blade portions.

8. The method as recited in claim 1, wherein the Step F further comprises a Step F1 to control a stroke of the punching head, such that the micro-holes formed after the spot-shaped cavities arranged in a row on the second surface of the metal plate and the linear groove on the first surface of the metal plate are interconnected have a minimum width in the vertical direction smaller than a thickness of the metal plate.

9. The method as recited in claim 1, wherein the Step F further comprises a Step F2 to control a stroke of the punching head, such that the micro-holes formed after the spot-shaped cavities arranged in a row on the second surface of the metal plate and the linear groove on the first surface of the metal plate are interconnected have a width along the linear groove greater than the width in the direction of feeding the metal plate.

10. The method as recited in claim 1, wherein the Step F further comprises a Step F3 to control a stroke of the punching head, such that the micro-holes formed after the spot-shaped cavities arranged in a row on the second surface of the metal plate and the linear groove on the first surface of the metal plate are interconnected are disposed at the top of the linear groove.

11. The method as recited in claim 1, further comprising a leveling process for leveling the first surface and the second surface of the metal plate after the Step J takes place.

12. The method as recited in claim 11, further comprising a coating process for coating a film onto the leveled first surface and second surface of the metal plate after the leveling process takes place.

13. The method as recited in claim 1, wherein the unit blade portions arranged in a row as described in Step B are in a sawtooth shape.

14. The method as recited in claim 1, wherein the spot shaped cavities are selectively formed to have a cross-sectional contour operable to reflect and destructively interfere with impinging sound waves.

15. The method as recited in claim 1, wherein the micro-holes are selectively formed to receive and attenuate sound waves therein.

16. The method as recited in claim 14, wherein the spot shaped cavities are selectively sized according to a desired range of sound wavelengths to be destructively interfered.

17. The method as recited in claim 15, wherein the width of the micro-holes are selectively sized according to a desired range of sound wavelengths to be attenuated.

* * * * *